US005791116A

United States Patent [19]

Skintzis

[11] Patent Number: 5,791,116

[45] Date of Patent: Aug. 11, 1998

[54] DEVICE FOR APPLYING STUCCO AND METHOD THEREFOR

[76] Inventor: George D. Skintzis, 13440 N. 44th St., Apt . 2128, Phoenix, Ariz. 85032

[21] Appl. No.: 755,683

[22] Filed: Nov. 25, 1996

[51] Int. Cl.[6] ..... E04G 17/00

[52] U.S. Cl. ..... 52/741.4; 52/396.06; 52/741.41; 52/448; 52/254; 52/366; 249/188; 118/505

[58] Field of Search ..... 52/99, 100, 396.04, 52/396.06, 741.41, 741.4, 742.16, 448, 717.01, 717.03, 717.05, 745.21, 745.15, 745.16, 254, 366, 376; 118/504, 505; 249/187.1, 188

[56] References Cited

U.S. PATENT DOCUMENTS

| | | | |
|---|---|---|---|
| 2,953,835 | 9/1960 | Armstrong et al. | 249/188 |
| 2,985,938 | 5/1961 | Rappas | 249/188 X |
| 2,994,905 | 8/1961 | Franker, Jr. | 52/717.05 X |
| 3,168,798 | 2/1965 | Berg | 52/699 X |
| 3,254,463 | 6/1966 | Moseley | 52/254 X |
| 3,608,254 | 9/1971 | Sklamberg et al. | 52/396.06 X |
| 3,782,680 | 1/1974 | Hopkins | 249/188 |
| 3,872,195 | 3/1975 | Stegmeier | 52/100 X |
| 4,138,807 | 2/1979 | Trachtenburg et al. | 52/741.4 X |
| 4,263,355 | 4/1981 | Sarkisian | 118/505 X |
| 4,531,858 | 7/1985 | Kirtley, Jr. | 52/99 X |
| 5,230,738 | 7/1993 | Wheeler | 118/504 |
| 5,628,159 | 5/1997 | Younts | 52/417 |

FOREIGN PATENT DOCUMENTS

| | | | |
|---|---|---|---|
| 2260334 | 6/1974 | Germany | 249/188 |
| 2348117 | 4/1975 | Germany | 249/188 |

OTHER PUBLICATIONS

U.S. Patent No. 3,807,107; Closure of Spacer Member and Method of Erecting A Fixed Frame Assembly; Issued to James L. Davis; Apr. 30, 1974.

U.S. Patent No. 3,667,174; Expansible Reveal With Frontal Tear Strip For Plaster Walls; Issued to Robert W. Arnett; Jun. 6, 1972.

U.S. Patent No. 4,651,488; Expansion Joint For Plaster Walls; Issued to Johhn D. Nicholas, et al.; Mar. 24, 1987.

U.S. Patent No. 4,397,123; Drywall Board Construction; Issued to Robert F. Parker; Aug. 9, 1983.

U.S. Patent No. 3,953,661; Extrusion Apparatus, Process And Article; Issued to Willard Q. Gulley; Apr. 27, 1976.

*Primary Examiner*—Wynn Wood Coggins
*Assistant Examiner*—Laura A. Callo
*Attorney, Agent, or Firm*—Harry M. Weiss; Jeffrey D. Moy; Harry M. Weiss & Associates, P.C.

[57] ABSTRACT

The present invention is directed to a removable spacing device and method therefor, for use in the application of stucco to a building's exterior. The removable spacing device is comprised of a section of tape and a substantially triangle-shaped spacer, and is applied to the edge of a window frame, door frame, or similar structure prior to the application of a layer of stucco adjacent thereto. After the stucco layer has dried, the removable spacing device is removed, and the resulting space created by the device is filled with caulk or a similar weatherproofing material. This device and method prevents the formation of small cracks between a stucco layer and adjacent frame, which cracks are too small to be filled with caulk and which allow the damaging penetration of water into the stucco and underlying layers.

1 Claim, 1 Drawing Sheet

DEVICE FOR APPLYING STUCCO AND METHOD THEREFOR

BACKGROUND OF THE INVENTION

1. Field of Invention

This invention relates generally to stucco application devices and methods therefor and, more particularly, to a device and method for permitting the application of stucco adjacent to a door frame, window frame, or like structure in a manner that prevents or at least significantly minimizes any cracking between the stucco and the adjacent structure.

2. Background of the Invention

This invention relates to the construction of a building having a stucco exterior. Where stucco is to be applied to the exterior of a building, it is necessary to cover the desired portions with stucco, without of course covering window frames, door frames, or other similar structures. Often, these structures that are to be adjacent the stucco-covered areas have wood or metal-type frames, but other frame materials may also be used. With construction of this type, it is desired to apply the stucco to the building exterior and as nearly as possible to the door frame, window frame, or other non-stucco covered surface, without actually covering that surface.

Typically, the practice is to apply wet stucco to the building exterior right up to the point where the non-stucco covered surface is present. However, when the stucco dries, a small crack generally appears between the stucco surface and the non-stucco covered surface. This crack tends to be large enough to allow water to pass through, yet too small to be filled with caulk or any other similar weather-proofing material. As a result, over time, the penetration of water will create cracking in the stucco and possible damage to the stucco and/or underlying structure.

Therefore, a need existed to provide a device and method that will allow the application of stucco in a manner that will not leave an uncovered crack between the stucco and uncovered surfaces following the drying of newly-applied stucco. The improved device and method should be relatively easy to use, so as to not unduly slow the stucco application process. The improved device and method should also be relatively inexpensive, so as to not unduly increase the cost of applying stucco to a building exterior.

SUMMARY OF THE INVENTION

In accordance with one embodiment of the present invention, it is an object of the present invention to provide an improved stucco application device and method therefor.

It is another object of the present invention to provide a stucco application device and method that will create a space between newly-applied stucco and an adjacent uncovered portion of a building, which space can subsequently be filled with a caulk type material to prevent the stucco from cracking and to prevent damage to the stucco or underlying structure.

It is another object of the present invention to provide a stucco application device that can be dispensed in roll form.

BRIEF DESCRIPTION OF THE PREFERRED EMBODIMENTS

In accordance with one embodiment of the present invention, a removable spacing device for use in the application of stucco is disclosed. The device comprises, in combination: adhesive tape means having a first adhesive side and a second non-adhesive side for removably securing the removable spacing device to an edge portion of a building material prior to the application of stucco adjacent thereto; and spacing means attached to the adhesive tape means for creating a space between the building material and the stucco large enough to be filled with a caulking-type material.

In accordance with another embodiment of the present invention, a method for applying stucco adjacent. to a building material is disclosed. The method comprises the steps of: providing adhesive tape means having a first adhesive side and a second non-adhesive side for removably securing the removable spacing device to an edge portion of a building material prior to the application of stucco adjacent thereto; and providing spacing means attached to the adhesive tape means for creating a space between the building material and the stucco large enough to be filled with a caulking-type material.

In accordance with still another embodiment of the present invention, a method for applying stucco adjacent to a building material is disclosed. The method comprises the steps of: providing adhesive tape means having a first adhesive side and a second non-adhesive side for removably securing the removable spacing device to an edge portion of a building material prior to the application of stucco adjacent thereto; providing spacing means attached to the adhesive tape means for creating a space between the building material and the stucco large enough to be filled with a caulking-type material; securing the adhesive tape means along an edge portion of a building material prior to the application of the stucco adjacent thereto so that the spacing means is at a substantially ninety-degree angle to the adhesive tape means; applying the stucco; allowing the stucco to dry; removing the adhesive tape means and the spacing means; and filling a space created by removal of the spacing means with a caulking-type material.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
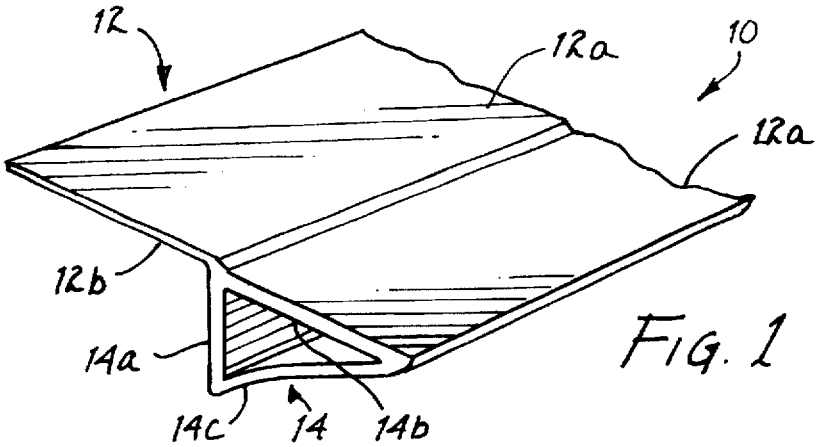
FIG. 1 is a perspective view of the removable spacing device of the present invention, prior to installation.
Figure 2:
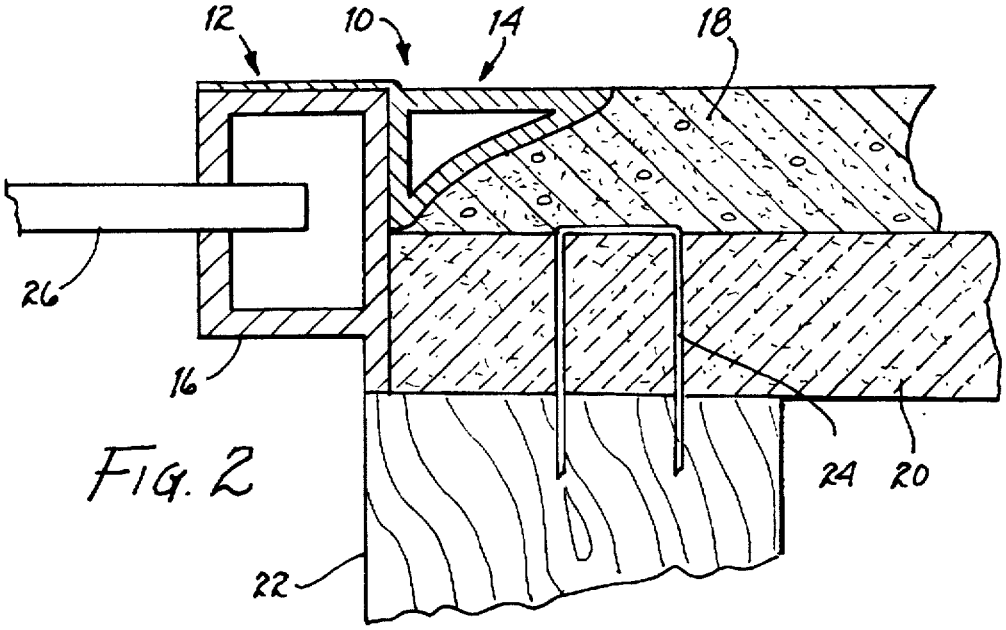
FIG. 2 is a cross-sectional, top view of the removable spacing device of the present invention, as installed between a stucco exterior and a non-stucco covered adjacent building surface.

Referring to the embodiment of FIGS. 1 and 2, reference number 10 refers generally to the removable spacing device of the present invention. The spacing device 10 comprises essentially two parts, a tape section 12 and a spacer section 14. Preferably, the spacer section 14 is substantially in the shape of a right triangle, having vertical side **14*a*, exposed horizontal top side 14*b*, and connecting tapered side 14*c*. The tape section 12 has a top, non-adhesive surface 12*a* and a bottom, adhesive surface 12*b*. Preferably, the tape section 12 has a side portion that extends over and is adhered or connected to the exposed side 14***b* of the spacer section 14, as shown in FIG. 1. It may be possible, however, to connect the tape section 12 and the spacer section 14 in other manners. Although other dimensions are possible without departing from the spirit or scope of the claimed invention, in the preferred embodiment, tape section 12 (excluding the portion of non-adhesive surface 12*a* covering exposed side 14*b*) has a width of one-half inch, horizontal top side 14*b* of spacer section 14 has a length of one-eighth of one inch, and vertical side 14*a* of spacer section 14 has a length of three-eighths of one inch.

Referring specifically to FIG. 2, an example of the use of the removable spacing device 10 in connection with the application of stucco adjacent a non-stucco covered window frame 16 is shown. Generally, before application of a stucco layer 18, a foam layer 20 is first applied to the exterior of the building. The foam layer 20 may be secured to a stud 22 with staples 24 (only one is shown). The window frame 16 retains a window 26. After the application of the foam layer 20 but before the application of the stucco layer 18, the removable spacing device 10 is installed on the window frame 16 as shown in FIG. 2. Specifically, the tape section 12 of the removable spacing device 10 is applied to an edge portion of the window frame 16 adjacent the area that is to be covered by the stucco layer 18, so that adjacent side 14*a* of the spacer section 14 abuts the window frame 16 at a substantially ninety degree angle to the tape section 12. The spacer section 14 may be comprised of a plastic or other similar material, and preferably is sufficiently flexible so that the removable spacing device 10 may be dispensed in roll form. The creation of evenly spaced perforations (not shown) in the spacer section 14 may also be used to allow the removable spacing device 10 to be dispensed in roll form.

The removable spacing device 10 should be applied along the entire length of the portion of the window frame 16 that is adjacent to the area to be covered with the stucco layer 18. After installation of the removable spacing device 10, the stucco layer 18 may then be applied. The stucco layer 18 should then be allowed to dry. Once the stucco layer 18 is dry, the removable spacing device 10 is removed, leaving a space substantially in the shape of spacer section 14.

Figure 3:
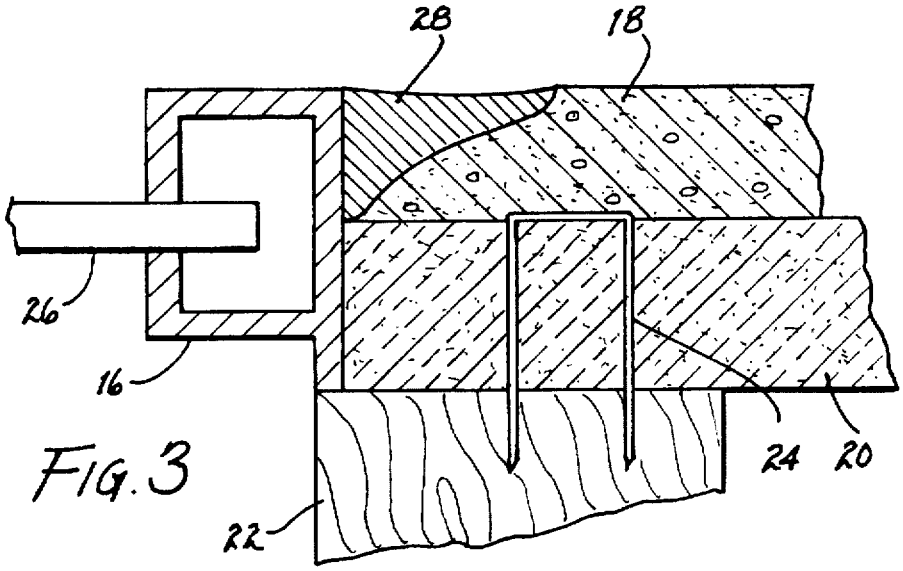
FIG. 3 is a cross-sectional, top view showing the caulk-filled space between a stucco surface and the adjacent non-stucco covered building surface, created by the use of the removable spacing device of the present invention.

Referring now to FIG. 3, after the removable spacing device 10 is removed, the space created by spacer section 14 is filled with caulk or similar weatherproofing material 28. The material 28 will substantially prevent the passage of moisture between the window frame 16 and the stucco layer 18, preventing damage to the stucco layer 18, the window frame 16, and perhaps the foam layer 20 and stud 22.

Although the spacer section 14 may be embodied in other than a substantially triangular shape, there are a number of advantages to the use of the substantially triangular shape as shown in FIGS. 1–3. The use of a substantially triangular shaped spacer section 14, as opposed to a rectangular shaped spacer section, will make it easier to remove the spacer section 14 after the stucco layer 18 has hardened, and will lessen the possibility of chipping of the hardened stucco layer 18. Additionally, it will be easier to apply caulk or other weatherproofing material. 28 in a sealed manner in a triangular shaped space, than in a substantially rectangular shaped space.

While the invention has been particularly shown and described with reference to preferred embodiments thereof, it will be understood by those skilled in the art that the foregoing and other changes in form and details may be made therein without departing from the spirit and scope of the invention.

I claim:

1. A method for applying stucco adjacent to a building material comprising the steps of:

providing adhesive tape means having a first adhesive side and a second non-adhesive side for removably securing said removable spacing device to an edge portion of a building material prior to the application of stucco adjacent thereto;

providing spacing means attached to said adhesive tape means for creating a space between said building material and said stucco large enough to be filled with caulk;

securing said adhesive tape means along an edge portion of a building material prior to the application of said stucco adjacent thereto so that said spacing means is at a substantially ninety-degree angle to said adhesive tape means;

applying said stucco;

allowing said stucco to dry;

removing said adhesive tape means and said spacing means; and filling a space created by removal of said spacing means with caulk.

* * * * *